United States Patent [19]

Johnson et al.

[11] 3,962,746

[45] June 15, 1976

[54] SELF-PROPELLED VACUUM CLEANER

[75] Inventors: Milton J. Johnson, Danville, Ky.; Joseph F. Schmitz, St. Paul, Minn.

[73] Assignee: Whirlpool Corporation, Benton Harbor, Mich.

[22] Filed: Dec. 6, 1974

[21] Appl. No.: 530,071

[52] U.S. Cl. ..... 15/340; 15/413

[51] Int. Cl.[2] ..... A47L 9/22

[58] Field of Search ..... 15/340, 354, 412, 413

[56] References Cited

UNITED STATES PATENTS

| | | | |
|---|---|---|---|
| 3,331,090 | 7/1967 | Reiber et al. | 15/413 X |
| 3,634,905 | 1/1972 | Boyd | 15/413 X |
| 3,854,164 | 12/1974 | Schmitz | 15/340 |

*Primary Examiner*—Leonard D. Christian
*Assistant Examiner*—C. K. Moore
*Attorney, Agent, or Firm*—Wegner, Stellman, McCord, Wiles & Wood

[57] ABSTRACT

A vacuum cleaner construction wherein the carriage wheels are driven by an electric motor. An improved air flow arrangement is associated with the drive motor for conducting relatively clean cooling air into the motor for heat transfer therefrom, and conducting the cooling air from the motor for delivery with air conducted from a suction inlet to a suction fan.

14 Claims, 4 Drawing Figures

SELF-PROPELLED VACUUM CLEANER

BACKGROUND OF THE INVENTION

1. Field of the Invention

This invention relates to vacuum cleaners and in particular to means for cooling a wheeled drive motor of a self-propelled vacuum cleaner.

2. Description of the Prior Art

In one form of vacuum cleaner construction, as shown in U.S. Pat. No. 2,980,939 of Charles H. Sparklin et al., owned by the assignee hereof, a vacuum cleaner nozzle structure is provided with a motor driving a rotatable brush by means of a belt connection therebetween. The motor is cooled by an air flow which is drawn into the motor by a conventional motor cooling fan provided in the motor. Cooperating seal flanges and wall means divide the interior of the nozzle into an upper passage for conducting relatively clean air to the motor and a lower air passage for conducting the dirt laden air to a suction means. As shown in FIG. 9 of the Sparklin et al. patent, air may be conducted through an opening 10*a* in the nozzle into the motor openings 18*a*, through the motor, outwardly through the motor openings 18*b*, and outwardly from the upper air passage. As shown, the motor is fixedly mounted to the nozzle, permitting the simple air flow arrangement.

In U.S. Pat. No. 3,675,268 of Erwin E. Nordeen, also owned by the assignee hereof, a vacuum cleaner construction is illustrated having a fan motor which is cooled by clean air delivered from the dirt collector into the motor housing and after passing through the motor housing, through suitable discharge openings to the ambient atmosphere.

In copending application Ser. No. 323,779, filed Jan. 15, 1973, now issued as U.S. Pat. No. 3,854,164 of Joseph F. Schmitz, and owned by the assignee hereof, a self-propelled upright vacuum cleaner construction is disclosed wherein cooling air is provided to the motor for driving the wheels thereof. A number of different embodiments are disclosed illustrating different methods of delivering the cooling air to the wheel drive motor.

Of the references cited by the examiner in said copending application, the most pertinent to the present invention would appear to be those of Melvin H. Ripple et al. U.S. Pat. No. 3,618,687, and Donald G. Smellie U.S. Pat. No. 2,300,266. These patents are considered pertinent in being directed to vacuum cleaner constructions utilizing two motors, including a motor for driving the suction fan means.

SUMMARY OF THE INVENTION

The present invention comprehends an improved vacuum cleaner construction having an improved means for effecting cooling of a wheel drive motor therein. More specifically, the present invention comprehends the provision of such a vacuum cleaner construction having means utilizing the air suction action of the suction fan of the vacuum cleaner for concurrently flowing relatively clean cooling air through the wheel drive motor and delivering the cooling air to the suction fan.

The wheel drive motor cooling air, in the illustrated embodiment, is delivered to the suction fan from the wheel drive motor to be drawn by the suction fan and delivered with dirt laden air, also drawn by the suction fan, through the main nozzle suction element.

The wheel drive motor is movably mounted to the nozzle for movement with the adjustably mounted wheels and the present invention comprehends an improved air flow conducting means for conducting relatively clean air to the adjustably mounted wheel drive motor and conducting this air from the wheel drive motor to the fixedly mounted suction fan.

The relatively clean air may be drawn into the wheel drive motor through an inlet in the upper portion of the nozzle spaced from the suction inlet for the dirt laden air. A filter may be provided for further assuring cleanliness of the air to be delivered to the wheel drive motor and may be effectively disposed at the clean air inlet in the nozzle.

In the illustrated embodiment, a duct is pivotally mounted to the movable wheel drive motor means and is slidably connected to the inlet means carried by the nozzle to accommodate the relative movement between the wheel drive means and the nozzle.

In the illustrated embodiment, a duct is provided between the wheel drive motor means and the suction fan for conducting the air therebetween. One end of the duct is movably connected to an outlet means of the wheel drive motor means and the opposite end of the duct is movably connected to the suction fan means. In the illustrated embodiment, the wheel drive means is provided with a tubular outlet with the duct being slidably received therein to effect the desired air flow connection therebetween. The opposite end of the duct is pivotally connected to the suction fan means and, thus, the transfer duct structure accommodates the relative movement between the adjustable wheel drive motor means and the suction fan fixedly mounted to the nozzle.

The air conducting structure of the present invention is extremely simple and economical while yet providing an improved cooling of the wheel drive motor means as discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
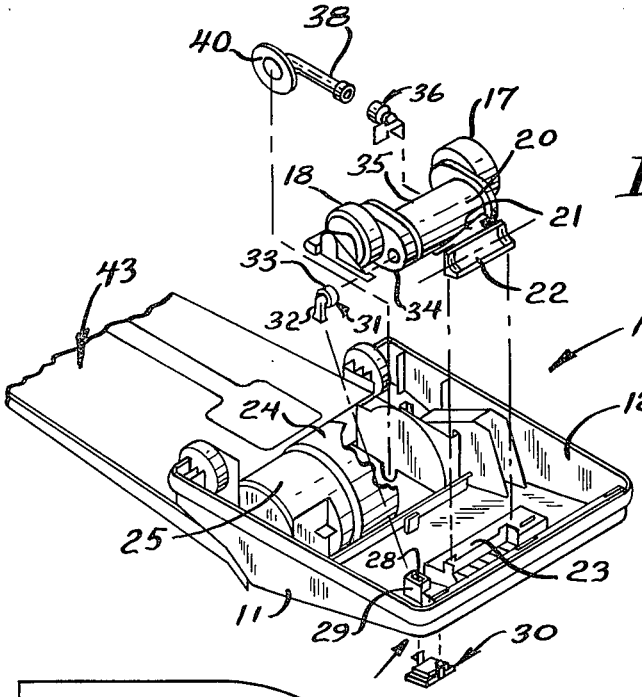
FIG. 1 is a fragmentary exploded isometric view of a vacuum cleaner construction having a wheel drive motor cooling means embodying the invention in looking at the underside of the nozzle arrangement.

In the exemplary embodiment of the invention as disclosed in the drawing, a vacuum cleaner construction generally designated 10 is shown to comprise a nozzle 11 defining a downwardly opening space 12 which is closed at the bottom by a conventional closure plate 13. The closure plate is provided with a front opening 14 through which projects a conventional beater brush 15 rotatably carried by the nozzle, and a second opening 16 through which projects a pair of front drive wheels 17 and 18 cooperating with a pair of rear wheels 19 for supporting the vacuum cleaner on a surface to be cleaned, such as floor surface F. Vertical adjustment of front wheels 17 and 18 effects a tilting of the nozzle 11 about the axis of rear wheels 19 for adjustably arranging the nozzle in any one of a plurality of different positions, from a lowermost position as illustrated in FIG. 3 to an upper position as illustrated in FIG. 4, thereby accommodating the vacuum cleaner to different carpet pile heights.

Figure 3:
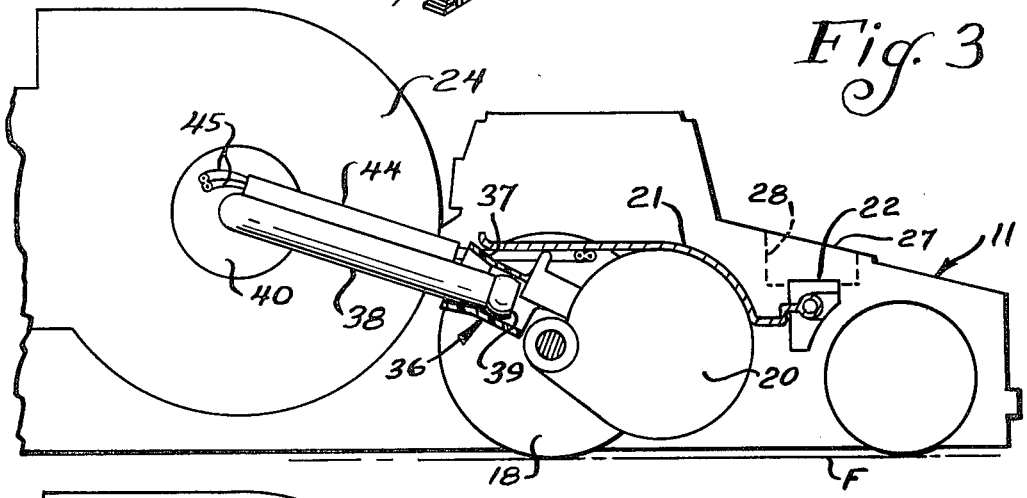
FIG. 3 is a longitudinal vertical section of the structure illustrating an arrangement thereof with the nozzle in a lowermost position.
Figure 4:
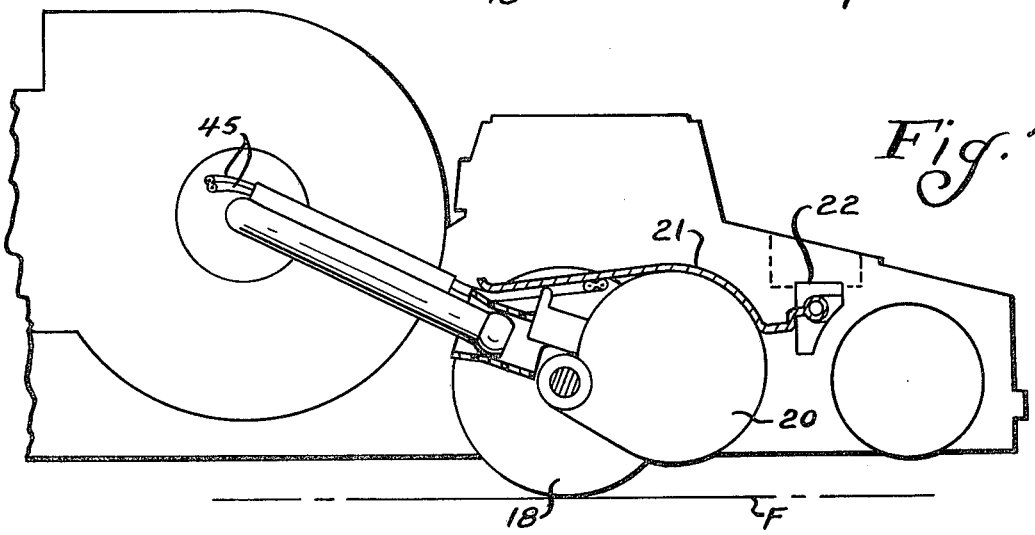
FIG. 4 is a longitudinal vertical section of the structure illustrating an arrangement thereof with the nozzle in a raised position.

Drive wheels 17 and 18 are driven by a suitable electric drive motor 20 provided with a pivot support 21 pivotally engaging complementary supports 22 and 23 secured to the underside of the nozzle whereby drive motor 20 is adjustably mounted to the nozzle to swing the wheels 17 and 18 in an arc as between the positions of FIGS. 3 and 4 in adjusting the elevation of the nozzle.

Dirt laden air is conventionally drawn through the suction inlet opening 14 to a suction fan 24 which is driven by a suitable second electric motor 25, the fan and motor being conventionally integrally housed and fixedly mounted to the nozzle. Thus, in the adjustment of the driven wheel height, relative movement occurs between the fixed suction fan 24 and the movable drive wheel motor 20. The present invention is concerned with delivering air through a fixed inlet generally designated 26 in an upper portion 27 of nozzle 11 to the relatively movable wheel drive motor 20 and from the relatively movable motor 20 to the fixedly mounted suction fan 24.

Figure 2:
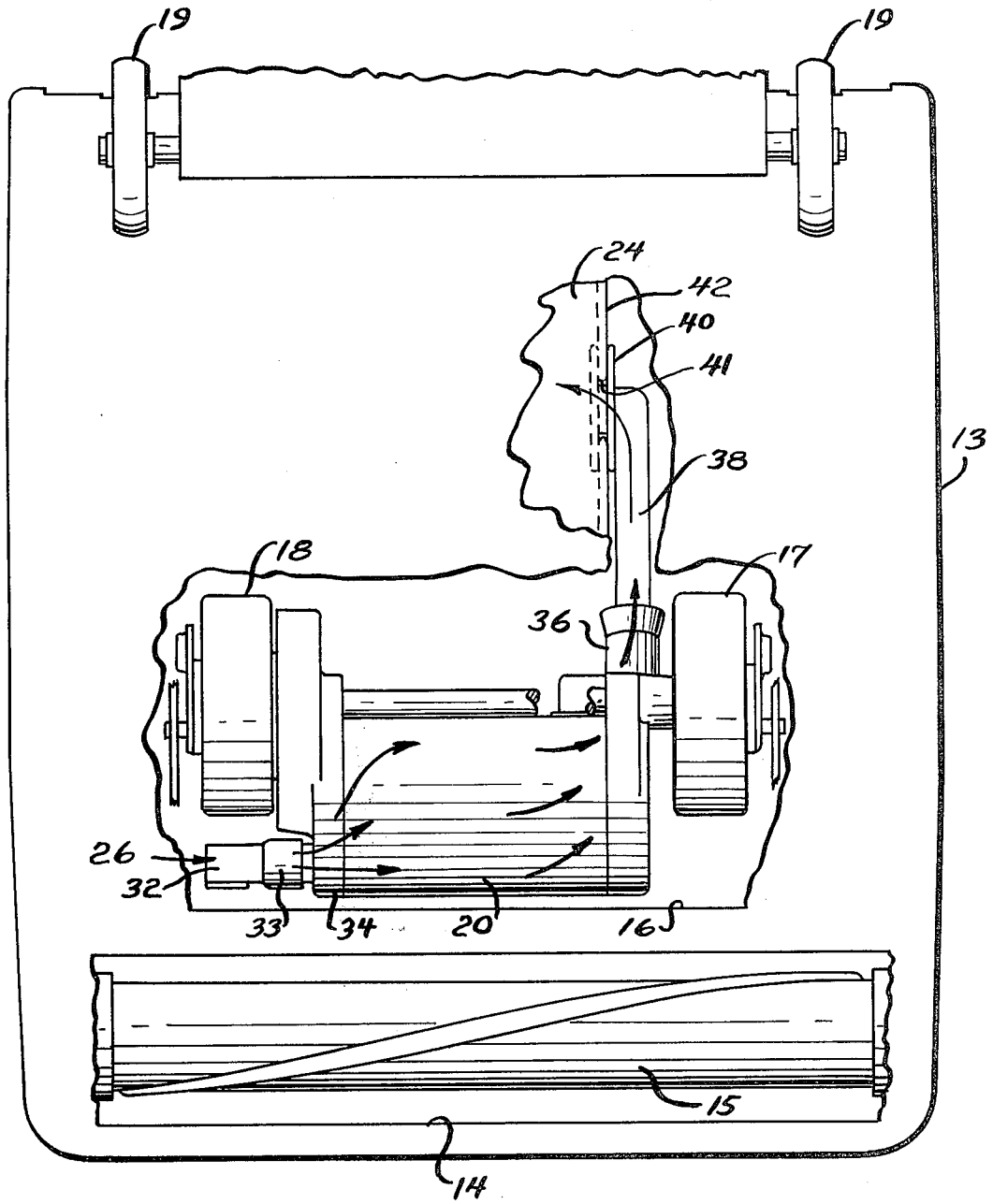
FIG. 2 is a bottom plan view of the nozzle with portions broken away to illustrate the arrangement of the air flow means.

More specifically, as best seen in FIGS. 1 and 2, the clean air inlet 26 is defined by an opening 28 in the nozzle portion 27 defined by a tubular wall 29. A filter element 30 is mounted to the nozzle across opening 28 for filtering air from above nozzle portion 27 and passed downwardly through the tubular connector 29. As opening 28 is spaced substantially from suction inlet opening 14 and substantially above the surface being cleaned, the air delivered to the filter is relatively clean and is further cleansed by its passage through the filter.

Air is conducted from connector 29 through a duct 31 having a first tubular portion 32 which is slidably vertically movable in connector 29, and a connecting portion 33 which is pivotally connected to one end portion 34 of the housing of motor 20.

The cooling air passes in heat exchange relationship with the motor to effect the desired cooling thereof and is discharged at the opposite end 35 of the motor housing through a discharge connector 36 defining an outwardly flared tubular wall 37. Air is conducted from connector 36 through a substantially rigid duct element 38 having a ball connector end 39 swingably movably received in the tubular discharge connector wall 37 to accommodate swinging movement of the connector 36 about the pivot axis of motor 20. The opposite end of duct 38 is defined by an annularly grooved connector 40 rotatably received in an opening 41 in the end wall 42 of the suction fan 24 whereby the duct 38 may swing about the pivot axis of the suction fan as the ball end 39 is moved accurately about the pivot axis of drive motor 20 in the adjustment of the wheel height.

Cooling air duct 38 includes a second passage 44 forming a conduit for the electrical conductors 45 conveying electric power to electric drive motor 20. Passage 44 stops short of ball connector end 39 so that conductors 45 will not interfere with the operation of ball end 39 and connector 36. Passage 44 provides protection for conductors 45 preventing displacement thereof which could lead to mechanical damage to the conductors or the normal insulating jacket as by abrasion or pinching.

In the operation of the vacuum cleaner, suction fan 24 sucks air through the interior of the nozzle from inlet 14 and a suitable dirt collector generally designated 43 which may comprise a conventional filter bag or the like. In the present invention, the relatively clean wheel drive motor air is drawn through the wheel drive motor by the suction fan concurrently with the drawing of the dirt laden air through nozzle 14 and is discharged together with the air sucked through nozzle 14 from the suction fan.

In summary, the cooling of the wheel drive motor is effected by conducting relatively clean air from a portion of the nozzle spaced from the dirt laden air suction inlet, through the drive motor and subsequently to the air suction means for delivering the relatively clean wheel drive motor cooling air together with the air drawn through the main suction nozzle dirty air inlet. The connecting means between a fixed clean air inlet and the movable wheel drive motor includes a substantially rigid duct having opposite ends movably connected therebetween. Similarly, the means for conducting air between the movable wheel drive motor and the fixedly mounted suction fan includes a substantially rigid tubular duct having means at the opposite ends movably connected thereto. The inlet for the wheel drive motor cooling air may be provided with a filter for further assuring the cleanliness of the cooling air and thereby effectively increasing the useful life of the wheel drive motor.

The air conducting means is extremely simple and economical of construction while yet providing an improved cooling of a vacuum cleaner wheel drive motor as discussed above.

The foregoing disclosure of specific embodiments is illustrative of the broad inventive concepts comprehended by the invention.

Having described the invention, the embodiments of the invention in which an exclusive property or privilege is claimed are defined as follows:

1. In a self-propelled vacuum cleaner structure having a nozzle provided with a lower suction inlet and an upper wall portion, air flow suction means carried by the nozzle for flowing dirt laden air through the nozzle suction inlet and a dirt collector, and propelling means carried by the nozzle including vertically adjustably mounted wheels movably supporting the nozzle on a surface to be cleaned and means for driving the wheels including an electric drive motor movably mounted to said nozzle, the improvement comprising duct means for connecting relatively clean air from externally of the nozzle through said upper wall portion of the nozzle to said drive motor for cooling the same and from said drive motor to said air suction means for delivering the relatively clean air from said drive motor with said air flowed from said nozzle suction inlet.

2. The self-propelled vacuum cleaner structure of claim 1 wherein said duct means includes a substantially rigid duct having one end movably connected to said air flow suction means and an opposite end movably connected to said movably mounted drive motor.

3. The self-propelled vacuum cleaner structure of claim 1 wherein said duct means includes an air flow suction outlet connector on said drive motor and a duct having one end pivotally connected to one of said air flow means and outlet connector and an opposite end slidably fitted to the other of said air flow suction means and outlet connector.

4. The self-propelled vacuum cleaner structure of claim 1 wherein said duct means includes a duct having one end defining a ball joint slidably and rotatably fitted into an airflow outlet connector on said drive motor and an opposite end connected to said air flow suction means.

5. The self-propelled vacuum cleaner structure of claim 1 including means pivotally mounting said drive motor to said nozzle.

6. The self-propelled vacuum cleaner structure of claim 1 including means pivotally mounting said drive motor to said nozzle, said wheels being carried by said drive motor for movement therewith in effecting vertical adjustment of the wheels relative to the nozzle.

7. The self-propelled vacuum cleaner structure of claim 1 wherein said duct means includes an inlet portion opening through said nozzle wall portion and means carried by said drive motor movably engaging said inlet portion.

8. The self-propelled vacuum cleaner structure of claim 1 wherein said duct means includes an inlet portion opening through said nozzle wall portion, and means carried by said drive motor movably engaging said inlet portion for conducting the relatively clean air to said drive motor, and further is provided with filtering means for filtering air flowed therethrough.

9. The self-propelled vacuum cleaner structure of claim 1 wherein said duct means includes a duct having one end defining a ball joint slidably and rotatably fitted into an airflow outlet connector on said drive motor and an opposite end connected to said air flow suction means, said duct further including a passage for electrical conductors for conveying electric power to said drive motor.

10. In a self-propelled vacuum cleaner structure having a nozzle provided with a lower suction inlet and an upper wall portion, air flow suction means carried by the nozzle for flowing dirt laden air through the nozzle suction inlet and a dirt collector, and propelling means carried by the nozzle including adjustably mounted wheels supporting the nozzle on a surface to be cleaned and means for driving the wheels including an electric drive motor movably mounted to said nozzle, the improvement comprising: first extensible duct means for conducting relatively clean air from exteriorly of the nozzle through said wall portion to said drive motor for cooling the same; and second duct means for conducting the clean air from the drive motor to said suction means.

11. The self-propelled vacuum cleaner of claim 10 wherein said first duct means is provided with a filter means for further assuring delivery of only clean air to said drive motor.

12. The self-propelled vacuum cleaner of claim 11 wherein said first duct means comprises a substantially rigid duct having one end slidably connected to said filter means.

13. The self-propelled vacuum cleaner of claim 10 wherein said first duct means defines an end portion connected to said drive motor for movement therewith.

14. The self-propelled vacuum cleaner of claim 10 wherein said second duct means is arranged to conduct the clean air from said drive motor to said air flow suction means.

* * * * *